US007028847B2

(12) United States Patent
Chen et al.

(10) Patent No.: US 7,028,847 B2
(45) Date of Patent: Apr. 18, 2006

(54) HIGH EFFICIENCY TWO-STAGE DYNAMIC CLASSIFIER

(75) Inventors: Michael M. Chen, Naperville, IL (US); Jianrong Chen, Naperville, IL (US)

(73) Assignee: ALSTOM Technology Ltd, Baden (CH)

( * ) Notice: Subject to any disclaimer, the term of this patent is extended or adjusted under 35 U.S.C. 154(b) by 150 days.

(21) Appl. No.: 10/449,407

(22) Filed: May 29, 2003

(65) Prior Publication Data

US 2004/0238415 A1 Dec. 2, 2004

(51) Int. Cl.
*B07B 9/00* (2006.01)
*B07D 4/00* (2006.01)

(52) U.S. Cl. ..... 209/713; 209/132; 209/133; 209/142; 209/710

(58) Field of Classification Search ..... 209/132, 209/133, 138, 713, 714
See application file for complete search history.

(56) References Cited

U.S. PATENT DOCUMENTS 2,913,109 A * 11/1959 Williams ..... 209/138
4,211,641 A * 7/1980 Jager ..... 209/710
4,257,880 A * 3/1981 Jones ..... 209/139.1
4,511,462 A * 4/1985 Folsberg ..... 209/140
4,564,442 A * 1/1986 Jager ..... 209/139.2
4,626,343 A * 12/1986 Folsberg ..... 209/138
4,689,141 A * 8/1987 Folsberg ..... 209/714
4,799,595 A * 1/1989 Binder ..... 209/135
4,869,786 A * 9/1989 Hanke ..... 209/139.2
5,120,431 A * 6/1992 Cordonnier ..... 209/135
5,301,812 A * 4/1994 Garrett et al. ..... 209/714
5,366,095 A * 11/1994 Martin ..... 209/139.2
5,624,039 A * 4/1997 Folsberg ..... 209/714
6,044,977 A * 4/2000 Csendes ..... 209/23
6,257,415 B1 * 7/2001 Wark ..... 209/722
6,776,291 B1 * 8/2004 Tirado et al. ..... 209/154

* cited by examiner

*Primary Examiner*—Donald P. Walsh
*Assistant Examiner*—Jonathan R Miller
(74) *Attorney, Agent, or Firm*—Arthur E. Fournier, Jr.

(57) ABSTRACT

A two-stage dynamic classifier (30, 30') for classifying a pulverized feed material (34, 34', 38) entrained in an air flow (31) includes a vertically extending housing having a lower feed material inlet (18), an upper feed material outlet (24), a processing section (47, 47') disposed between the feed material inlet and the feed material outlet, and a lower tailings discharge (26). A classifier conditioner (32) is disposed in a lower portion of the processing section and a turbine classifier (42, 44) is disposed in an upper portion of the processing section.

6 Claims, 3 Drawing Sheets

HIGH EFFICIENCY TWO-STAGE DYNAMIC CLASSIFIER

BACKGROUND OF THE INVENTION

This invention relates to particulate matter classifiers. More particularly, the present invention relates to apparatus for separating particles of a certain fineness from larger particles.

It has long been known in the prior art to provide apparatus for purposes of effecting the grinding or pulverizing of certain materials. More specifically, the prior art is replete with examples of various types of apparatus that have been used to effect such grinding of a multiplicity of materials. In this regard, in many instances discernible differences of a structural nature can be found to exist between individual ones of the aforesaid apparatus. The existence of such differences is, in turn, attributable for the most part to the diverse functional requirements that are associated with the specific applications in which such apparatus are designed to be employed. For instance, in the selection of the particular type of apparatus that is to be utilized for a specific application one of the principal factors to which consideration must be given is that of the nature of the material that is to be ground in the application. Another factor to which consideration must be given is that of the fineness to which it is desired to grind the material.

Turning next to a consideration of separator devices, as the name given thereto implies, the function of a separator device is to effectuate in some preestablished fashion a separation of material which is made to enter the separator device. Apparatus have long been known to be available in the prior art which are suitable for use for such a purpose.

One such separator apparatus that is a mechanical air separator or classifier. One application in which particular use has been made of mechanical air separators is that relating to the grinding and classifying of cement wherein a mechanical air separator device has been combined with a grinding device so as to form a closed circuit therewith. When operated in closed circuit combination with a grinding device, the mechanical air separator is designed to skim off the fines as fast as they are produced such that the grinding device works only on fresh material without wasting power. The tailings from the mechanical air separator, however, are discharged back to the grinding device for further reduction. After being reground in the grinding device, the reground material is returned to the mechanical air separator along with the feed that is being supplied thereto so that a constant circulating load is established between the grinding device and the mechanical air separator. Mechanical air separators are also commonly employed in closed circuit grinding operations for producing limestone sand to meet close specifications of granular sand material to be used in bituminous concrete, mortar, as an aggregate and many other uses; for making fine, uniform cake mixes and for the production of protein-enriched grades of flour; for producing a high fineness, uniformly classified, hydrated lime for chemical and spray purposes; for classifying numerous food products including sugar, cocoa, milk powder, food mixtures with various ingredients, corn starch and wheat starch, and soya bean meal; in applications where manufactured chemicals are required in closely sized form, i.e., for making the various grades ranging from extremely fine to the granular dust free gradations of such chemicals as soda ash and sodium phosphate; in the beneficiation of certain materials such as talc, kaolin and clays, and phosphate rock for purposes of removing therefrom impurities in the form of silica, flint and other foreign materials; for classifying metal powders consisting of copper, bronze, iron and various alloys and for de-dusting of seacoal for foundry facing use, etc.

As regards the matter of efficiency, the higher the efficiency of a mechanical air separator, the closer the fractional recovery comes to 100% at the finest particle sizes. A mechanical air separator's inability to attain 100% fractional recovery is referred to as bypassing. More specifically, bypassing is defined as being the difference between a numerical value of 100% and the amount of fractional recovery that is actually attained at the finest particle sizes. Bypassing is believed to be caused by one or more of the following three events. One of these is the internal recirculation of fines. A second is the inadequate dispersion of the feed in the air prior to the feed reaching the classifying zone of the mechanical air separator. The third is the existence of an excessive material/air ratio which has the effect of causing interference between particles within the classifying zone of the mechanical air separator.

In a variation utilized for the production of pulverized coal that is to be burned as fuel in a coal fired power generation system, the mechanical air separator is housed within the coal pulverizing apparatus. In particular, separation of pulverized material occurs as a consequence of causing the air within which the pulverized material is entrained to follow a tortuous path through the mechanical air separator, whereby in the course of changing directions of flow the larger of the particles of the pulverized material lose their momentum and are made to return to the surface of the grinding table whereat they are subjected to further pulverization. The means by which this separation is generally accomplished is by way of a static classifier, as shown in U.S. Pat. No. 5,873,156 for example, or a rotary classifier, as shown in U.S. Pat. No. 5,657,877 for example.

In a static classifier, the flow of primary air and coal particles entrained therein is directed through a series of stationary turning vanes which make up the aforesaid convoluted path. Said turning vanes are canted at an angle to the direction of the flow of the stream of primary air and coal particles so as to cause the coarsest (and therefore heaviest particles) to fall out of the primary air stream and return to the grinding table to suffer a second pulverizing action.

In a rotary classifier, the flow of primary air and coal particles entrained therein is directed through a series of vanes disposed as an inverted, truncated cone and revolving about the central vertical axis of the housing at a predetermined rotational velocity in a squirrel cage fashion. The vanes are canted at an angle to the direction of the flow of the stream of primary air and coal particles entrained therein so as to present to the stream a window through which the stream of primary air and coal particles may pass unimpeded. However, the rotational velocity of the vanes coupled with the velocity of the primary air stream and the coal particles entrained therein acts to separate the coal particles into two groups. A first group of particles are those that are relatively coarse or heavy and therefore unable to pass unimpeded through the aforesaid window and are thus returned to the grinding table to suffer a second pulverizing action. A second group of particles are those that are relatively fine or light and therefore able to pass unimpeded through the window and thus be directed through the remainder of the bowl mill and delivered to the furnace of the steam generator.

For a fixed velocity of the primary air stream, by the judicious manipulation and control of the aforesaid rotational velocity of the vanes, the relative fineness of the two groups of coal particles may be adjusted, i.e., by increasing the rotational velocity of the vanes, the fineness of the coal particles that pass through the aforesaid window increases. In other words only increasingly finer particles will pass unimpeded as rotational velocity increases whereas increasingly coarser coal particles will pass unimpeded as rotational velocity is reduced. Conversely, for a fixed rotational velocity of the vanes, by the judicious manipulation and control of the aforesaid velocity of the primary air stream, the relative fineness of the two groups of coal particles may be adjusted, i.e., by increasing the velocity of the primary air stream, the fineness of the coal particles that pass through the aforesaid window decreases. In other words coarser and coarser particles will pass unimpeded as primary air velocity increases and finer and finer coal particles will pass unimpeded as primary air velocity is reduced.

SUMMARY OF THE INVENTION

Briefly stated, the invention in a preferred form is a two-stage dynamic classifier for classifying a pulverized feed material entrained in an air flow. The classifier comprises a vertically extending housing including a lower feed material inlet, an upper feed material outlet, a processing section disposed between the feed material inlet and the feed material outlet, and a lower tailings discharge. A classifier conditioner is disposed in a lower portion of the processing section and a turbine classifier is disposed in an upper portion of the processing section. The air flow and the entrained coarse and fine feed material particles are received in the housing through the feed material inlet and flow upward to the lower portion of the processing section, where the classifier conditioner throws a major portion of the coarse feed material particles against the housing. The air flow and the entrained fine feed material particles and the remaining portion of the coarse feed material particles flow upward to the upper portion of the processing section, where the turbine classifier throws the remaining portion of the coarse feed material particles against the housing. The air flow and entrained fine feed material particles are discharged from the housing through the feed material outlet. The coarse feed material particles fall from the processing section and are discharged from the housing through the tailings discharge.

The classifier conditioner includes a conditioner assembly axially disposed within the housing. The conditioner assembly comprises an axially extending rotor, a substantially circular mounting plate mounted coaxially on the rotor, and a plurality of circumferentially-spaced, conditioner blades extending radially from the mounting plate. The conditioner blades have a fan effect creating a strong swirl in the air flow. The conditioner blades also have a shutter effect separating the coarse feed material particles from the fine feed material particles.

The conditioner blades may lie on a substantially vertical plane extending through the axis. Alternatively, the conditioner blades may define an angle with a vertical plane extending through the axis. The conditioner blades have a rectangular or a tapered shape. The conditioner blades are removably mounted to the mounting plate.

The turbine classifier comprises an axially extending rotor and a plurality of circumferentially spaced classifier vanes carried on the rotor. The vanes impart additional centrifugal force on the remaining portion of the coarse feed material particles.

The turbine classifier has a diameter D and the classifier conditioner is positioned at a distance H below the turbine classifier, such that $1>H/D>0.0$ and preferably $0.5>H/D>0.0$.

It is an object of the present invention to provide a new and improved high efficiency classifier that is operative to separate a finished product which contains particles having a predetermined fineness from a ground material having coarse and fine particles.

It is another object of the present invention to provide a classifier which preconditions the air flow before classifying the particles to improve the efficiency of the classifier.

It is still another object of the present invention to provide a classifier which is not subject to flow recirculation.

A further object of the present invention is to provide a classifier having blades which are removable and adjustable.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
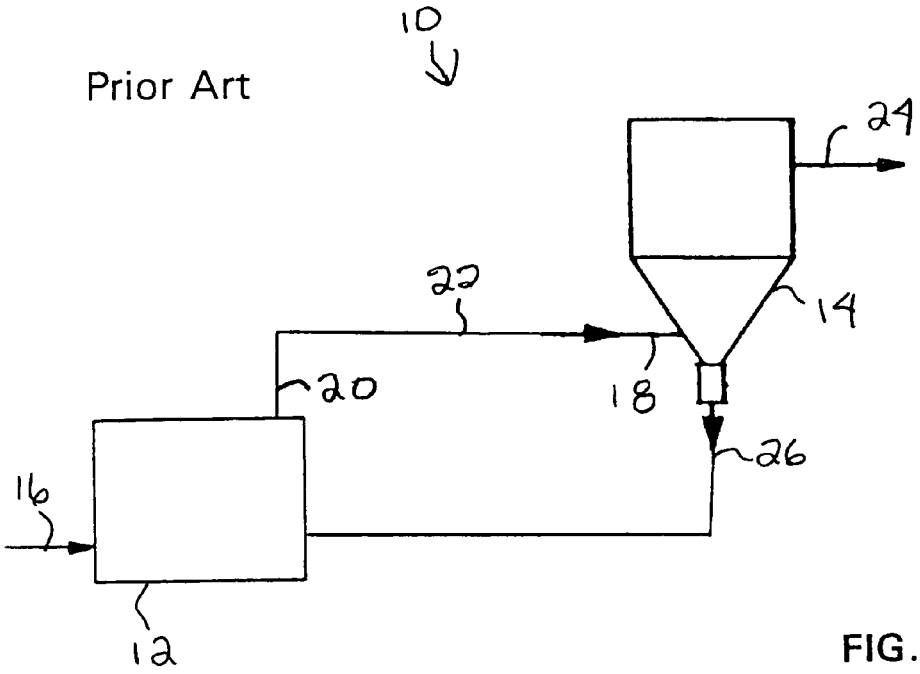
FIG. 1 is a schematic view of a conventional separator system including a pulverizer/grinder and a classifier.

With reference to FIG. 1, there is illustrated therein a conventional separator system, generally designated by the reference numeral 10, which includes a grinding means 12 and a separator or classifier 14 which are interconnected in a closed circuit flow path.

The separator system 10 is designed to be operative both to grind material and to thereafter separate the ground material into a finished product which embodies particles that are of a predetermined size. To this end, the mode of operation, simply stated, is such that material which is to be ground is fed to the grinding means 12 wherein the material undergoes grinding. To this end, raw material in the required quantity and at the required rate is supplied from a suitable source of supply thereof (not shown) to the grinding means 12 by any suitable sort of transport means to the inlet 16 of the grinding means 12. After being ground in the grinding means 12, the material is fed in the form of feed material to the separator 14. Within the separator 14, a separation is had of the finer feed material from the coarser feed material. Thereafter, the finer feed material is discharged from the separator system 10 as finished product which embodies particles that are of a predetermined size. The coarser feed material, on the other hand, is recirculated from the separator 14 to the grinding means 12 for additional grinding.

Figure 2:
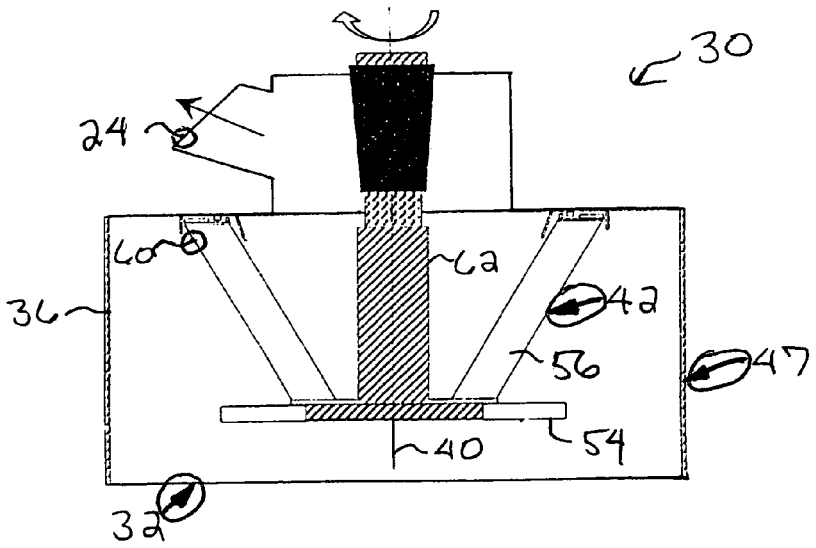
FIG. 2 is a front view in vertical section of a first embodiment of two-stage dynamic classifier in accordance with the invention.

The grinding means 12 may take the form of any suitable conventional form of grinding device that is commonly found utilized for purposes of effecting the grinding of solid materials. However, a two-stage dynamic classifier 30, 30' in accordance with the invention (FIGS. 2 and 3) is particularly suited for use with roller mills, imp mills and jet stream classification systems. Since the nature of the construction as well as the mode of operation of such mills is well-known to those skilled in the art of the grinding of materials, it is not deemed necessary to set forth a detailed description thereof herein or to include an illustration thereof in the drawing. Rather, it is deemed sufficient for purposes of obtaining an understanding of the subject matter of the present invention to simply note herein that the function of the grinding means 12 is to effect the grinding of the solid material that is fed thereto. For purposes of accomplishing the grinding thereof within the grinding means 12, the raw material and the pulverized, feed material is conveyed therethrough by means of a flow of gas. This gas, which preferably is air, is supplied through any suitable conventional means to the inlet 16 of grinding means 12.

After being ground in the grinding means 12, the feed material is discharged from the grinding means 12 and transported to the inlet 18 of the separator 14. Where the grinding means 12 and separator 14 are separate structures, the feed material is discharged through an outlet 20 and is transported to the inlet 18 the separator 14 through the use of any suitable form of conventional transport means 22. One form that the transport means 22 can take is that of a bucket elevator. For the purpose of accomplishing the classification of the feed material within the separator 14, the feed material is conveyed therethrough by means of a flow of air, preferably vented from the grinding means 12. Where the separator 14 is disposed within the grinding means 12, internal structures of the grinding means 12 define a passageway for the feed material, which is entrained in the air which had been supplied to the grinding means 12.

Within the separator 14, a classification is had of the stream of air and feed material such that the feed material particles which are of the desired particle size while still entrained within the stream of air are discharged along with the stream of air through the outlet 24. The coarser particles of feed material, i.e., those which are not of the desired particle size, are caused to be discharged from the separator 14 through a tailings discharge 26. The tailings are recirculated back to the grinding means 12 for further reduction. The fine particles while still entrained in the air stream exit from the separator 14 through the outlet 24 and exit the separator system 10.

Figure 4:
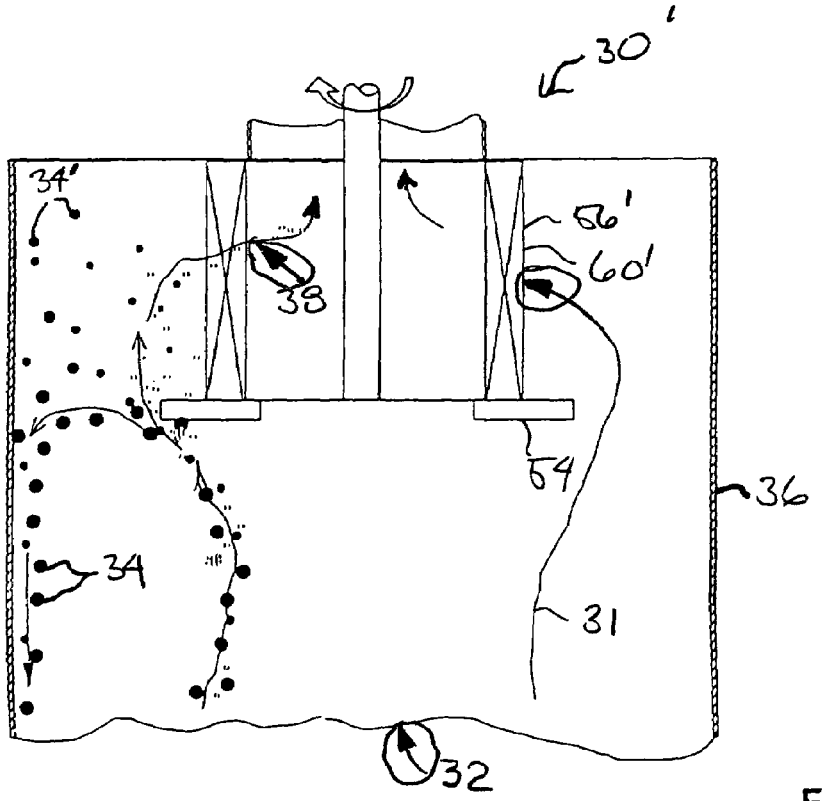
FIG. 4 is a simplified, schematic, vertical section of the two-stage dynamic classifier of FIG. 3, illustrating the trajectories of the coarse and fine particles.

With reference to FIG. 4, in a two-stage dynamic classifier 30, 30' in accordance with the invention, the feed material 34, 34', 38 /air flow 31 first passes through a classifier conditioner 32, where a majority of the larger, heavier particles 34 are thrown outward against the housing sides 36, where they lose velocity and eventually drop out of the classifier 30, 30' through the tailings discharge 26 and are returned to the grinding means 12 for regrinding. The air stream 31, carrying the smaller, lighter fines 38, and the remaining portion of the coarse particles 34' spirals upwardly and inwardly toward classifier axis 40 until it encounters a turbine classifier 42, 44, which separates any remaining oversized particles 34' from the air stream 31. The oversized particles removed by the turbine classifier 42, 44 are also thrown outward against the housing sides 36, where they lose velocity and eventually drop out of the classifier 30, 30' through the tailings discharge 26.

Figure 5:
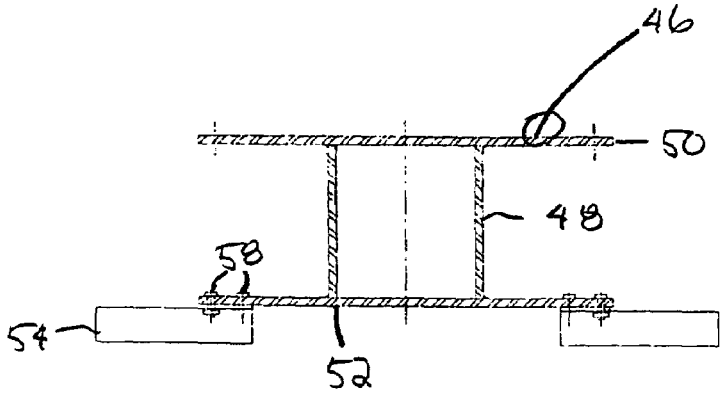
FIG. 5 is a cross-section view of the conditioner assembly.
Figure 6:
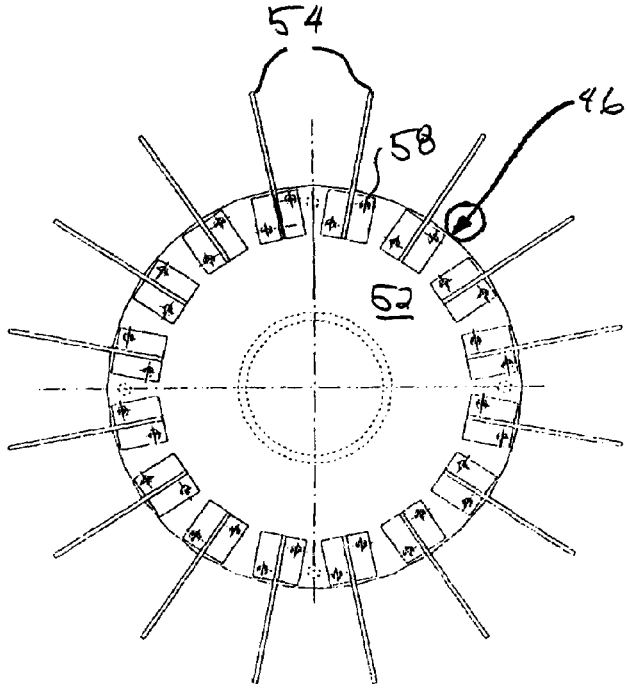
FIG. 6 is a bottom view of the conditioner assembly of FIG. 5.

With reference to FIGS. 5 and 6, the classifier conditioner 32 includes a conditioner assembly 46 which is axially disposed within a processing section 47, 47' the housing 36, located between the lower inlet 18 and the upper outlet 24. The conditioner assembly 46 has a rotor 48 and circular upper and lower mounting plates 50, 52, the lower mounting plate 52 carrying a plurality of circumferentially-spaced, conditioner blades 54. The conditioner blades 54 pre-condition the air flow 31 to the turbine classifier 42, 44, making the air flow 31 more uniform and thereby allowing the blades or vanes 56, 56' of the turbine classifier 42, 44 to operate more efficiently. The conditioner blades 54 have a fan effect, creating a strong swirl air flow (i.e. strong centrifugal force) that forces the large oversize particles 34 to the housing sides 36. This fan effect can also provide additional pressure head for the air flow. The conditioner blades 54 also have a shutter effect which assists in separating the oversized particles 34.

The conditioner blades 54 may be aligned vertically or with a cant angle to the flow direction, and may have a rectangular or tapered shape. The conditioner blades 54 are removably mounted to the lower mounting plate 52, preferably by bolts 58, allowing worn conditioner blades 54 to be removed and replaced. In addition, conditioner blades 54 having a rectangular/tapered shape may be removed and replaced by conditioner blades 54 having a tapered/rectangular shape, respectively, depending on the specific installation.

Figure 3:
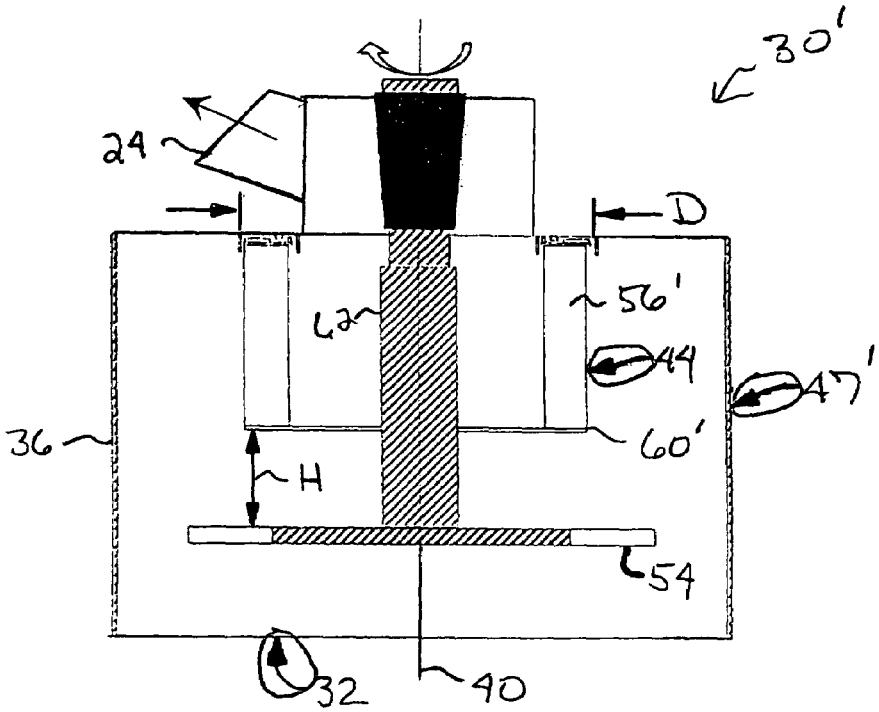
FIG. 3 is a front view in vertical section of a second embodiment of two-stage dynamic classifier in accordance with the invention.

The turbine classifier may be a conical turbine classifier 42 (FIG. 2) or a cylindrical turbine classifier 44 (FIG. 3). The feed material/air flow moving upwardly from the classifier conditioner 32 encounters a classifier cage 60, which defines a circumferential inlet with a plurality of circumferentially-spaced classifier vanes 56, 56' carried on an axial rotor 62. The vanes 56, 56' impart additional centrifugal force on the feed material 34', 38 /air flow 31, further swirling the feed material particles 34', 38 around the housing such that the smaller, lighter fines 38 are swirled up and out through the outlet 24. The larger particles 34', not yet suitable for burning, are separated centrifugally outward, drop and are discharged through the tailings discharge 26 for regrinding.

The distance H between two stages 32, 42, 44 of the classifier 30, 30' should be within the range of $1>H/D>0.0$ (where D is the diameter of the turbine classifier) and preferably within the range of $0.5>H/D>0.0$, in order to maximize the swirl effect.

It should be appreciated that the use of the classifier conditioner 32 significantly increases the lifetime of the two-stage dynamic classifier 30, 30', by reducing the rate of wear of the vanes 56, 56' of the turbine classifier 42, 44. The top portion of the vanes of conventional turbine classifiers are generally subject to severe wear from impact with the oversized particles, due to the fact that inertia of the oversized particles entrained in the air flow prevents such particles from turning with the air flow. Since the blades are generally welded in place, the wear problem results in a relatively short lifetime for conventional turbine classifiers. In the subject invention, the conditioner blades 54 remove most of the oversized feed material particles 34 from the air flow 31. Consequently, only a relatively small portion of oversized feed material particles 34' remain entrained in the air flow 31 which reaches the turbine classifier 42, 44. Since the conditioner blades are removably mounted to the lower mounting plate 52, they may be replaced as they are worn out by the oversized feed material particles 34.

It should also be appreciated that lumps of agglomerated fine feed material particles impacting the conditioner blades 54 will be broken-up into the individual fines 38 for further classification by the turbine classifier 42, 44. The de-agglomeration of fine particles is particularly important for jet stream applications, where the feed material is normally extremely fine, having particle sizes down to the micron range.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A dynamic classifier for classifying a pulverized feed material entrained in an air flow, the feed material being composed of a mixture of coarse and fine feed material particles, said dynamic classifier comprising:

a vertically extending housing defining an axis and including a lower feed material inlet, an upper feed material outlet, a processing section disposed between said lower feed material inlet and said upper feed material outlet, said processing section having a lower portion and an upper portion, and a lower tailings discharge;

a classifier conditioner disposed in said lower portion of said processing section and including a rotor extending axially along said axis of said vertically extending housing, a substantially circular mounting plate mounted coaxially on said rotor of said classifier conditioner so as to extend in perpendicular relation to said rotor of said classifier conditioner, and a plurality of circumferentially-spaced conditioner blades extending radially from said substantially circular mounting plate in perpendicular relation to said rotor of said classifier conditioner;

a turbine classifier disposed in said upper portion of said processing section in spaced relation to said classifier conditioner, said turbine classifier including a rotor extending axially along said axis of said vertically extending housing, and a plurality of circumferentially-spaced classifier blades carried on said rotor of said turbine classifier so as to extend in substantially parallel relation to said axially extending rotor of said turbine classifier, and said turbine classifier having a diameter D and said turbine classifier being positioned at a distance H above said classifier conditioner such that $1>H/D>0.0$; and wherein the air flow and the entrained coarse and fine feed material particles are received in said vertically extending housing through said lower feed material inlet and flow upward to said lower portion of said processing section, said classifier conditioner is operative to throw a major portion of the coarse feed material particles against said vertically extending housing, the air flow and the entrained fine feed material particles and a remaining portion of the coarse feed material particles flow upward to said upper portion of said upper portion of said processing section, said turbine classifier is operative to throw the remaining portion of the coarse feed material particles against said vertically extending housing and to discharge the air flow and entrained fine feed material particles from said vertically extending housing through said upper feed material outlet, and the coarse feed material particles fall from said processing section and are discharged from said vertically extending housing through said lower tailings discharge.

2. The dynamic classifier of claim 1 wherein said turbine classifier is positioned at a distance H above said classifier conditioner such that $0.5>H/D>0.0$.

3. The dynamic classifier of claim 1 wherein said plurality of circumferentially-spaced conditioner blades also have a shutter effect to assist in effecting the separation of the coarse feed material particles from the fine feed material particles.

4. The dynamic classifier of claim 1 wherein said plurality of circumferentially-spaced conditioner blades each have a rectangular shape.

5. The dynamic classifier of claim 1 wherein said plurality of circumferentially-shaped conditioner blades each have a tapered shape.

6. The dynamic classifier of claim 1 wherein said plurality of circumferentially-shaped conditioner blades are each removably mounted to said substantially circular mounting plate.

* * * * *